US009186024B2

(12) United States Patent
Lee

(10) Patent No.: US 9,186,024 B2
(45) Date of Patent: Nov. 17, 2015

(54) WET TISSUE SUPPLY APPARATUS

(71) Applicant: Hong Ok Co., Ltd., Guri-si (KR)

(72) Inventor: Jong-Cheol Lee, Guri-si (KR)

(73) Assignee: HONG OK CO., LTD., Guri-Si (KR)

( * ) Notice: Subject to any disclaimer, the term of this patent is extended or adjusted under 35 U.S.C. 154(b) by 0 days.

(21) Appl. No.: 14/464,900

(22) Filed: Aug. 21, 2014

(65) Prior Publication Data

US 2015/0289731 A1 Oct. 15, 2015

(30) Foreign Application Priority Data

Apr. 11, 2014 (KR) ..... 10-2014-0043375

(51) Int. Cl.
*A47K 10/42* (2006.01)
*A47K 10/32* (2006.01)

(52) U.S. Cl.
CPC ..... *A47K 10/426* (2013.01); *A47K 2010/3286* (2013.01)

(58) Field of Classification Search
None
See application file for complete search history.

(56) References Cited

U.S. PATENT DOCUMENTS 3,749,313 A * 7/1973 Weitmann ..... 239/127
4,667,846 A * 5/1987 Marceau ..... 221/34
5,375,616 A * 12/1994 Chen ..... 134/105
5,443,084 A * 8/1995 Saleur ..... 134/58 R
5,829,278 A * 11/1998 Koo ..... 68/205 R
6,668,843 B2 * 12/2003 Chen ..... 134/122 R
7,677,410 B2 * 3/2010 Lee ..... 221/258
7,856,941 B2 * 12/2010 Nelson et al. ..... 118/325

FOREIGN PATENT DOCUMENTS

| | | |
|---|---|---|
| JP | 63267321 | 11/1988 |
| JP | 0824157 | 1/1996 |
| KR | 1019970010286 | 3/1997 |
| KR | 200320406 | 7/2003 |
| KR | 200337091 | 12/2003 |
| KR | 1020110007298 | 1/2011 |
| KR | 1020120027566 | 3/2012 |
| KR | 1020130093380 | 8/2013 |

* cited by examiner

*Primary Examiner* — Leslie A Nicholson, III
*Assistant Examiner* — Ayodeji Ojofeitimi
(74) *Attorney, Agent, or Firm* — Lex IP Meister, PLLC

(57) ABSTRACT

Disclosed herein is a wet tissue supply apparatus including: a storage box containing dry tissues put on top of each other therein and having a first hole; an exit member having a second hole which is opposed to the first hole inside the storage box, the exit member enabling a user to draw out the dry tissues contained in the storage box through the first hole; a water container which is mounted above the exit member and the storage box and has a water outlet; an opening and closing member mounted at the water outlet of the water container and located between the first hole and the second hole to open and close the water outlet while being lifted; and a push member mounted on the exit member and located beneath the opening and closing member to lift the opening and closing member, wherein the dry tissue gets wet with the water of the water container while passing between the first hole and the second hole.

33 Claims, 17 Drawing Sheets

WET TISSUE SUPPLY APPARATUS

CROSS-REFERENCES TO RELATED APPLICATION

This application claims priority to Korean Patent Application No. 10-2014-0043375 filed on Apr. 11, 2014, the contents of which are incorporated herein by reference.

BACKGROUND OF THE INVENTION

1. Field of the Invention

The present invention relates to a wet tissue supply apparatus, and more particularly, to a wet tissue supply apparatus which can easily convert dry tissue into wet tissue just using water in houses, restaurants, industrial sites, and so on.

2. Background Art

Wet tissue has conditions for growing molds because wet tissue is wet in a sealed state. In the wet tissue manufacturing industries, it is a general recognition that it is impossible to produce wet tissue products if toxic preservatives are not put. Moreover, the shocking fact that harmful ingredients of disinfectants for humidifiers are contained in wet tissue causes a rapid shrinking of consumer confidence in the wet tissue market.

Recently, technologies to allow users to use wet tissue for a long time without using such toxic preservatives have been disclosed. For instance, when wrapping paper which has antibacterial activity and a cap are used, an amount of preservatives contained in wet tissue can be reduced. However, because the disclosed technologies just reduce content of preservatives or other chemical ingredients but do not completely use preservatives or other chemical ingredients, they cannot relieve consumers' anxiety.

Moreover, recently an apparatus for manufacturing wet tissue just using water. As a relevant conventional invention, Korean Patent Laid-open no. 2011-0007298 discloses a "method for manufacturing wet tissue and a storage box of wet tissue". The prior art is a technique to manufacture wet tissue on the spot using a compression plate after saturating dry tissue in water. The prior art does not have harmfulness related with preservatives or other chemical ingredients because the prior art is to manufacture wet tissue just using water.

PRIOR ART

Korean Patent Laid-open No. 2011-0007298 entitled "method for manufacturing wet tissue and a storage box of wet tissue"

SUMMARY OF THE INVENTION

Accordingly, the present invention has been made to solve the above-mentioned problems occurring in the prior arts, and it is an object of the present invention to provide a wet tissue supply apparatus which can easily convert dry tissue into wet tissue just using water.

It is another object of the present invention to provide a wet tissue supply apparatus which allows a user to draw out dry tissue without making dry tissue into wet tissue.

Technical objects to be achieved by the present invention are not limited by the above-mentioned technical problems, and the above and other objects and merits of the present invention will be apparent from the following detailed description of the preferred embodiments of the invention to those skilled in the art.

To accomplish the above object, according to the present invention, there is provided a wet tissue supply apparatus including: a storage box containing dry tissues put on top of each other therein and having a first hole; an exit member having a second hole which is opposed to the first hole inside the storage box, the exit member enabling a user to draw out the dry tissues contained in the storage box through the first hole; a water container which is mounted above the exit member and the storage box and has a water outlet; an opening and closing member mounted at the water outlet of the water container and located between the first hole and the second hole to open and close the water outlet while being lifted; and a push member mounted on the exit member and located beneath the opening and closing member to lift the opening and closing member, wherein the dry tissue gets wet with the water of the water container while passing between the first hole and the second hole.

The opening and closing member includes a lid part for opening and closing the water outlet and bar parts connected to the lower portion of the lid part, and the push member lifts the bar parts upwardly such that the lid part opens and closes the water outlet.

The bar parts are elastically lifted by a first elastic member mounted between the lower portions of the bar parts and the water container.

The push member comprises a protrusion for lifting the bar parts upwardly.

The protrusion has an inclined face to lift the bar parts upwardly, and the bar part is located above the inclined face such that the lid part opens the water outlet when the push member moves forwardly toward the storage box, and the bar part is located beneath the inclined face such that the lid part closes the water outlet when the push member moves backwardly.

The protrusion is formed in a semicircular shape to lift the bar parts upwardly, and the lid part opens the water outlet twice when the bar part is located above the protrusion while the push member moves forwardly and backwardly toward the storage box, but closes the water outlet when the bar part goes over the protrusion.

In a case that there are a plurality of the water outlets, a plate body for connecting lower portions of the bar parts is further mounted, and a semicircular protrusion corresponding to the protrusion is further formed beneath the plate body.

A recess type housing is formed above the second hole of the exit member, and the push member is inserted and mounted into the housing to lift the bar parts upwardly.

The housing has an upper face which is opened such that the push member and the bar parts come into contact with each other, and the housing includes guide grooves formed at left and right sides thereof, and the push member includes guide protrusions inserted into the guide grooves.

The face of the push member on which the guide protrusion is formed is elastically and detachably fit into the guide groove through a cut line.

The housing includes a second elastic member mounted inside the housing to elastically actuate the push member.

The exit member includes a first recess formed in the face where the second hole is formed, and the second hole and the housing are respectively formed in the first recess, and a first cover is mounted at the first recess to open and close the first recess.

The first cover is rotatably mounted at the first recess to open and close the first recess.

The water container has a second recess, the water outlet is formed in the second recess, and the lid part opens and closes the second recess in a watertight manner to open and close the water outlet.

A skirt member of an oval shape for guiding the water of the water outlet to the dry tissue is mounted beneath the water container, and the bar parts are located inside the skirt member, and the push member penetrates the skirt member to lift the bar parts upwardly.

The skirt member includes a water sprinkling member mounted therein to sprinkle the water of the water outlet into several streams.

The water sprinkling member includes a plurality of sprinkling holes and groove lines for inducing the water of the water outlet to the sprinkling holes.

The water container is detachably connected to the exit member and the storage box.

The storage box is a container of which upper face is opened, and the upper face is opened when the water container is separated from the exit member and the storage box.

The water container is a container of which upper face is opened, and a second cover is rotatably mounted at the water container to open and close the opened upper face.

A first packing member is mounted in the water container to provide watertightness between the water container and the second cover.

The wet tissue supply apparatus further includes a gutter member which traverses a lower portion of the exit member and a lower portion of the storage box and goes in and out in a drawer type.

The gutter member is a container of which upper face is opened.

The gutter member includes a third cover rotatably mounted to open and close the opened upper face of the gutter member, and the third cover has a recovery hole for recovering the water of the water outlet to the gutter member.

The gutter member includes a second packing member to provide watertightness between the gutter member and the third cover.

The exit member is detachably mounted at the storage box to be able to rotate.

Projecting parts which get in contact with each other are respectively formed on the opposed faces of the storage box and the exit member to form a movement path of the dry tissues.

A slide preventing member is mounted at the lower portions of the exit member and the storage box.

The storage box includes a push plate member mounted therein to elastically push the dry tissue.

The exit member includes a first water-absorbing member mounted to surround the second hole in order to wet the dry tissue by absorbing the water of the water outlet.

The storage box includes a second water-absorbing member mounted to surround the first hole in order to wet the dry tissue by absorbing the water of the water outlet.

The first and second water-absorbing members are mounted detachably.

The second hole includes a leak preventing member to prevent water from leaking to the outside when the user draws out the dry tissue soaked with the water of the water outlet from the second hole.

The wet tissue supply apparatus according to the preferred embodiments of the present invention can easily convert dry tissue into wet tissue just using water, such as mineral water, purified water, tap water or the like, at home, in restaurants, industrial sites, and so on, thereby having no harmfulness of preservatives or other chemical ingredients because. Moreover, the wet tissue supply apparatus according to the preferred embodiments of the present invention is not harmful to human bodies and allows the user to make sanitary and clean wet tissue anytime and anywhere because it has a compact structure and is easy to carry.

Furthermore, the wet tissue supply apparatus according to the preferred embodiments of the present invention allows the user to selectively use wet tissue and dry tissue using one apparatus because the user can draw out dry tissue without making wet tissue. Therefore, there is no need for the user to prepare dry tissue separately.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
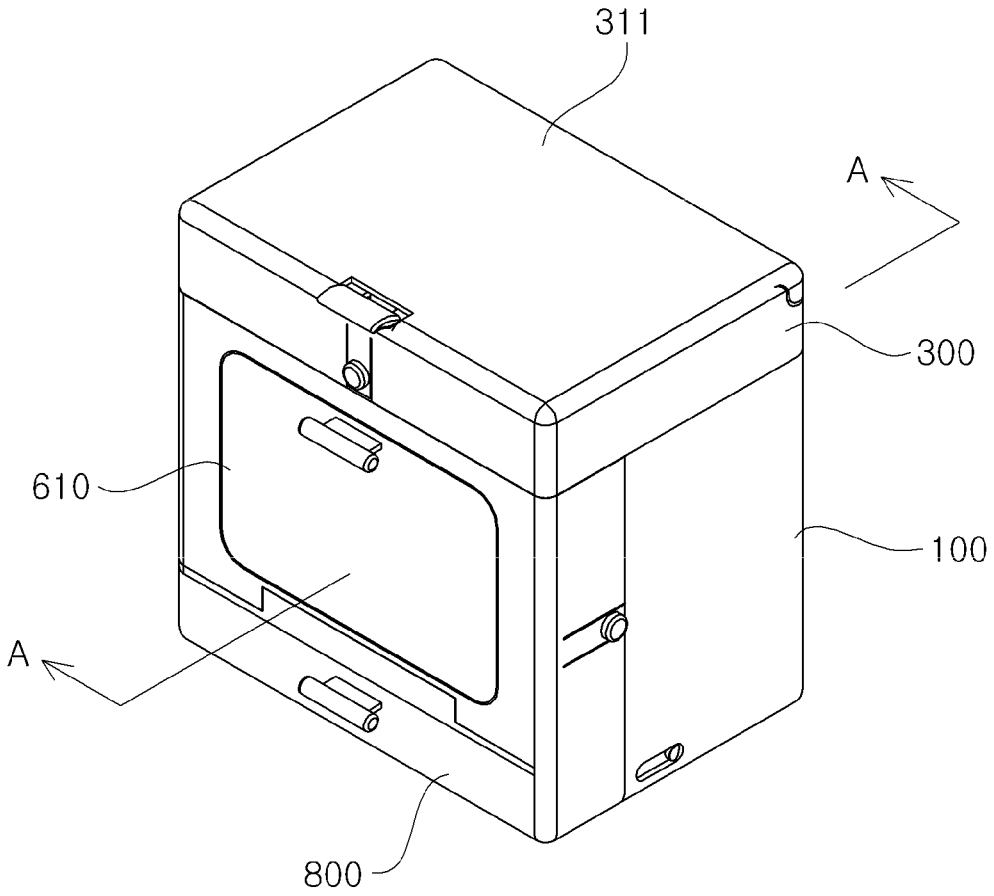
FIG. 1 is a view showing a wet tissue supply apparatus according to a preferred embodiment of the present invention.

Hereinafter, reference will be now made in detail to the preferred embodiments of the present invention with reference to the attached drawings. In the drawings, the same components have the same reference numerals even though they are illustrated in different figures. In addition, in the description of the present invention, when it is judged that detailed descriptions of known functions or structures related with the present invention may make the essential points vague, the detailed descriptions of the known functions or structures will be omitted.

As shown in FIGS. 1 to 4, a wet tissue supply apparatus according to the preferred embodiment of the present invention includes a storage box 100, an exit member 200, a water container 300, an opening and closing member 400 and a push member 500. The storage box 100, the exit member 200, the water container 300, the opening and closing member 400 and the push member 500 may be made of a synthetic resin material or a metallic material. Some of the components may be made of the synthetic resin material and the other components may be made of the metallic material. The water container 300 may be made of a transparent material to easily measure water levels.

The storage box 100 is formed in a box shape, contains dry tissues put on top of each other in the storage box, and has a first hole 101. The exit member 200 has a second hole 201. The exist member 200 is disposed in the storage box 100 in such a way as to be opposed to the first hole 101. Dry tissues 1 put on top of each other inside the storage box 100 are drawn out through the first hole 101 from the second hole 201.

The dry tissues 1 are vertically put on top of each other inside the storage box 100, and are drawn out through the first hole 101 from the second hole 201. While one dry tissue 1 is being drawn out, another dry tissue 1 comes out with the former dry tissue 1 and is on standby. A part of the dry tissue 1 coming out with the former dry tissue protrudes from the second hole 201 and is on standby to be easily drawn out.

The water container 300 is mounted above the exit member 200 and the storage box 100. The water container 300 has a water outlet 301 to drain water contained in the water container 300. The opening and closing member 400 is mounted at the water outlet 301 of the water container 300 and is located between the first hole 101 and the second hole 201 to open and close the water outlet 301 while being lifted up and down. The push member 500 is mounted on the exit member 200 and located below the opening and closing member 400 to lift the opening and closing member 400.

When a user presses the push member 400 with one hand to lift the opening and closing member 400 upwardly, the wet tissue supply apparatus according to the preferred embodiment of the present invention opens the water outlet 301 of the water container 300 in order to drain water. The user draws out the dry tissue 1, which protrudes through the second hole 201 and the first hole 101, from the storage box 100 with the other hand. The actions of the two hands are carried out at the same time, and the dry tissue 1 drawn out between the first hole 101 and the second hole 201 gets wet with water drained through the water outlet 301 to thereby be made into wet tissue.

According to the wet tissue supply apparatus of the present invention, the user can use the dry tissue 1 contained in the storage box 100 anytime and anywhere by drawing out the dry tissue 1 through the second hole 201 and the first hole 101 in a case that the user does not press the push member 400.

Figure 5:
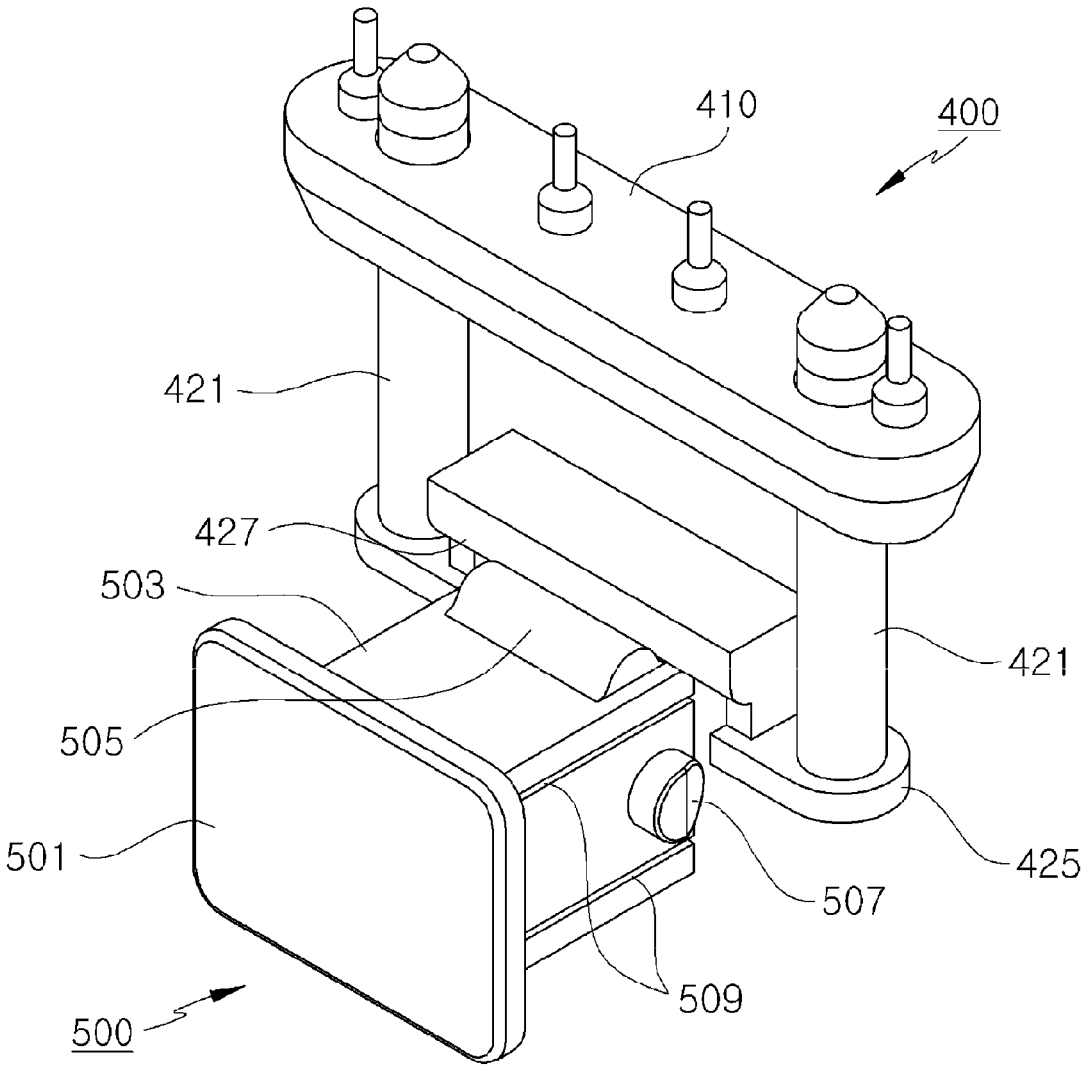
FIG. 5 is a view showing an opening and closing member and a push member of the wet tissue supply apparatus.
Figure 6:
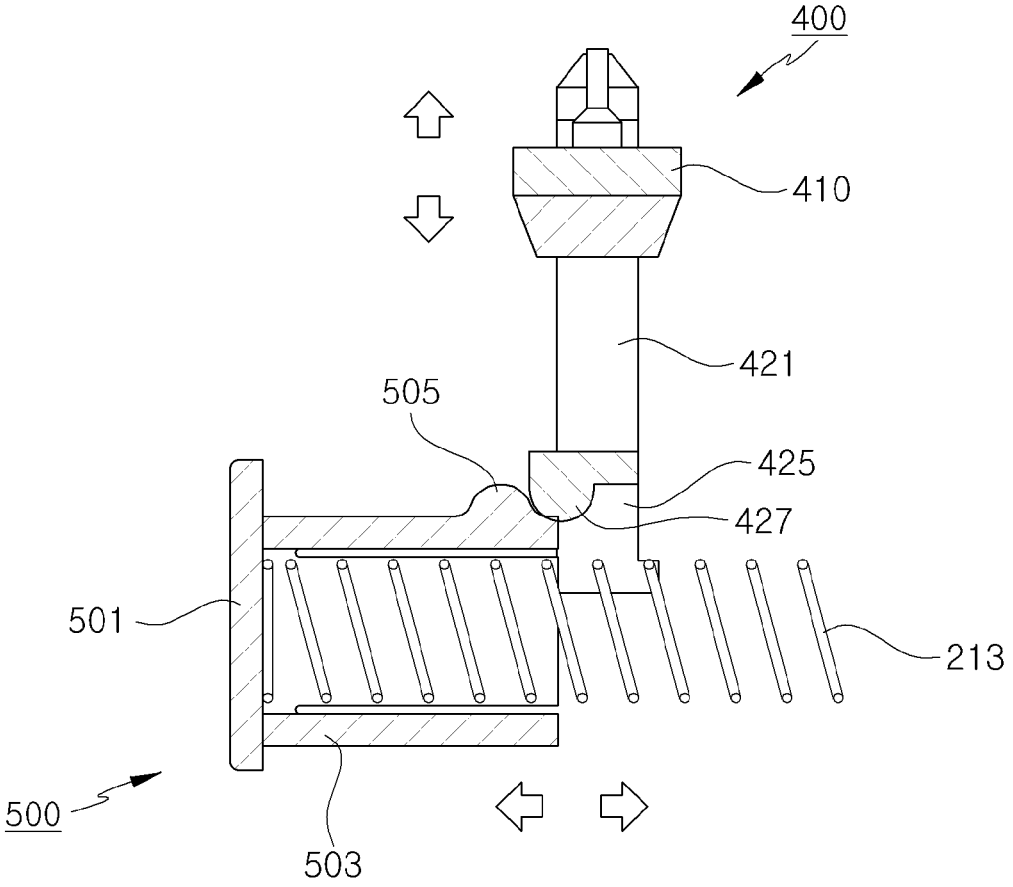
FIG. 6 is a sectional view of FIG. 5.

As shown in FIGS. 5 and 6, the opening and closing member 400 includes a lid part 410 which is fit into the water outlet 301 of the water container 300 and bar parts 421 connected beneath the lid part 410. When the push member 500 lifts the bar parts 421, the lid part 410 gets out of the water outlet 301, and hence, the opening and closing member 400 opens and closes the water outlet 301. The lid part 410 is made of a synthetic resin material, such as rubber or silicon to close the water outlet 301 in a watertight manner.

Figure 4:
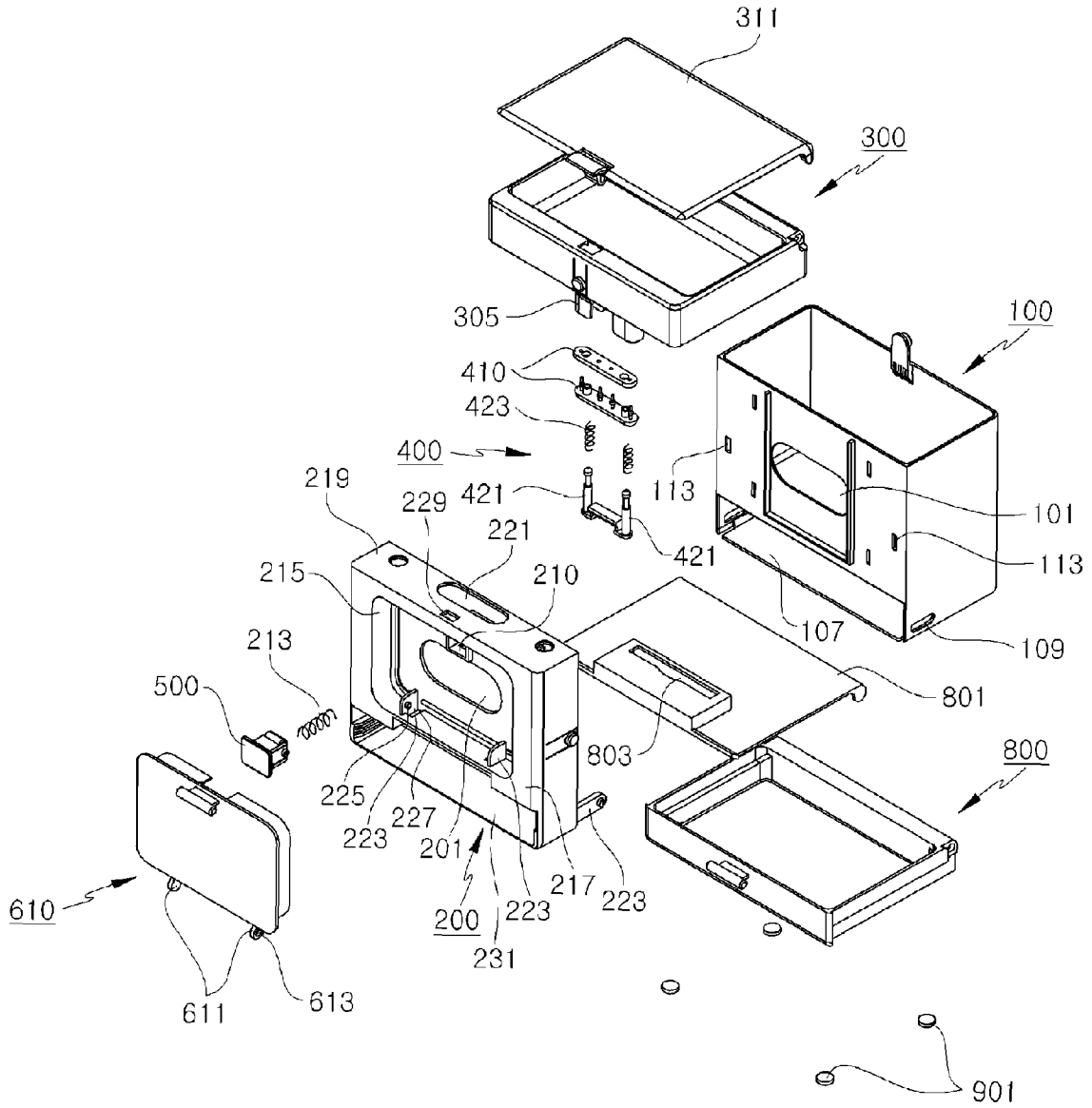
FIG. 4 is an exploded view of the wet tissue supply apparatus.

The bar parts 421 can be elastically lifted when a first elastic member 423 is mounted between the bar parts 421 and the water container 300 (See FIG. 4). The first elastic member 423 is contracted when the push member 500 pushes the bar parts 421 upwardly to lift the bar parts 421, and when the pushing action of the push member 500 is finished, the elastic member 423 is expanded to its original state to return the bar parts 421 to their initial positions. The first elastic member 423 continuously gives elasticity to the bar parts 421 which are returned to their initial positions, such that the lid part 410 firmly closes the water outlet 301 with watertightness. It is preferable that the first elastic member 423 be made of a stainless steel material which is resistant to corrosion. It is preferable that the first elastic member 423 be formed in a spring type.

Figure 7:
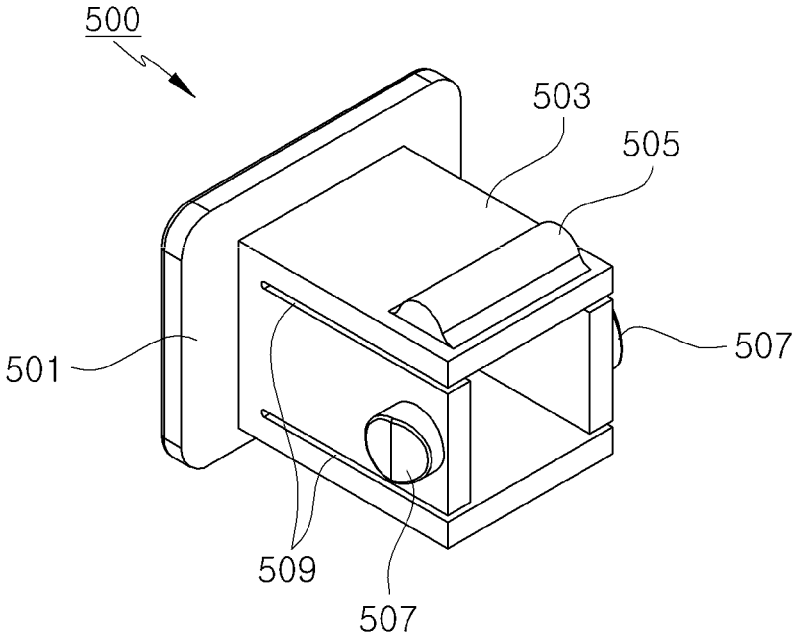
FIG. 7 is a view showing the push member of the wet tissue supply apparatus.

As shown in FIG. 7, the push member 500 includes a horizontal plate part 501 having a finger pressing part and a rectangular case part 503 horizontally connected to the horizontal plate part 501. The push member 500 further includes a protrusion 505 formed on the rectangular case part 503 to lift the bar parts 421 upwardly.

Not shown in the drawings, but the push member 500 may include a protrusion 505 of which the face facing the bar part 421 is an inclined face in order to lift the bar part 421 upwardly. When the horizontal plate part 503 of the push member 500 moves toward the storage box 100, the bar part 421 is ascended along the inclined face, and the lid part 410 gradually opens the water outlet 301. When the bar part 421 is located at the top of the inclined face, the lid part 410 completely opens the water outlet 301.

On the contrary, when the push member 500 moves backwardly, the bar part 421 is descended along the inclined face, and when the bar part 421 is located below the inclined face, the lid part 410 completely closes the water outlet 301. When the user continuously presses the push member 500, wet tissue which sufficiently gets wet with water is manufactured. However, when the push member 500 is continuously pressed by a child's mischief, there is a problem that water is continuously drained.

As shown in FIG. 6, the protrusion 505 of the push member 500 is formed in a semicircular shape to lift the bar part 421. In this case, while the push member 500 moves forwardly or backwardly toward the storage box 100, the bar part 421 is located at the top of the protrusion 505 twice, and hence, the lid part 410 opens the water outlet 301 twice. When the bar part 421 goes over the protrusion 505, the lid part 410 closes the water outlet 301.

That is, when the push member 500 moves forwardly toward the storage box 100, the bar part 421 is ascended along the protrusion 505 so as to open the water outlet 301. When the push member 500 moves further forwardly, the bar part 421 is descended along the protrusion 505 so as to close the water outlet 301. When the push member 500 is continuously pressed, the water outlet 301 is closed to prevent water from being drained.

On the contrary, when the push member 500 moves backwardly, the bar part 421 is ascended along the protrusion 505 so as to open the water outlet 301. When the push member 500 moves further backwardly, the bar part 421 is descended along the protrusion 505 and is returned to its original position so as to close the water outlet 301.

The action of the push member 500 may be carried out elastically, and thereby, the backward movement of the push member 500 is carried out automatically. The forward and backward movements of the push member 500 are carried out while the dry tissue 1 comes out through the second hole 201, and the water outlet 301 is opened twice while the push member 500 moves forwardly and backwardly so as to drain water. Because the front part and the middle part of the dry tissue 1 get wet while the push member 500 moves forwardly and the middle part and the rear part of the dry tissue 1 get wet while the push member 500 moves backwardly, the wet tissue supply apparatus according to the preferred embodiment of the present invention provides sufficiently wet tissue. Even though the push member 500 is continuously pressed by a child's mischief, the water outlet 301 is opened intermittently, there is no problem that water is drained continuously.

Figure 8:
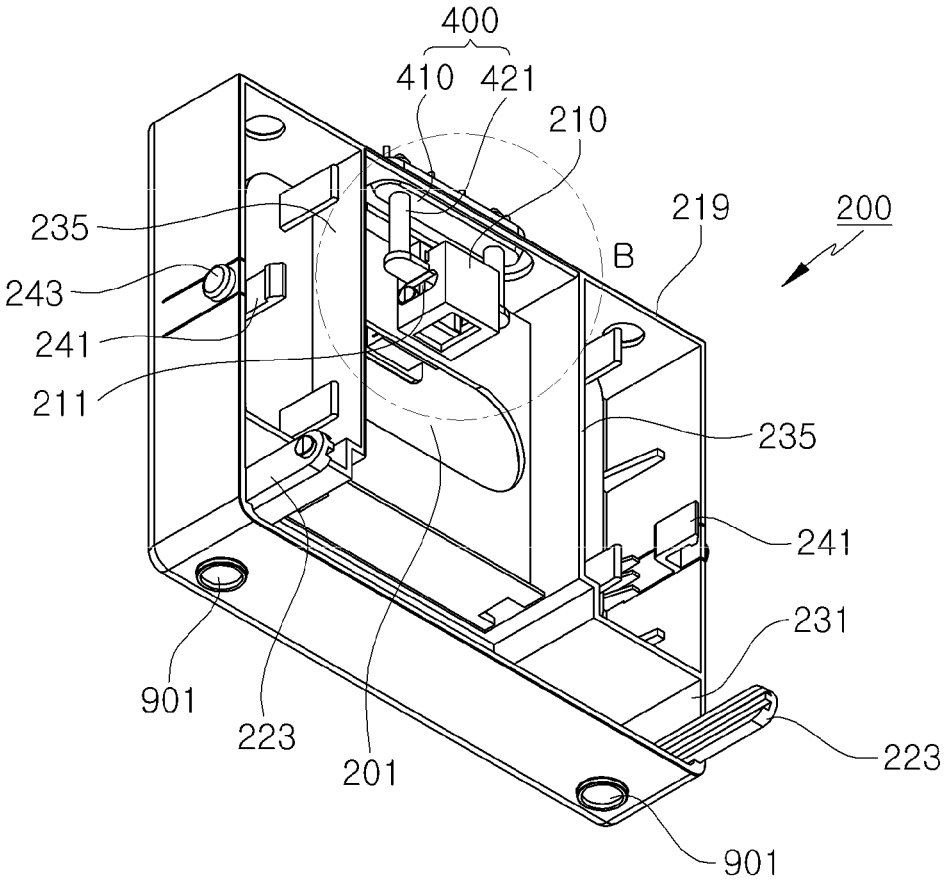
FIG. 8 is a rear side view of an exit member of the wet tissue supply apparatus.
Figure 9:
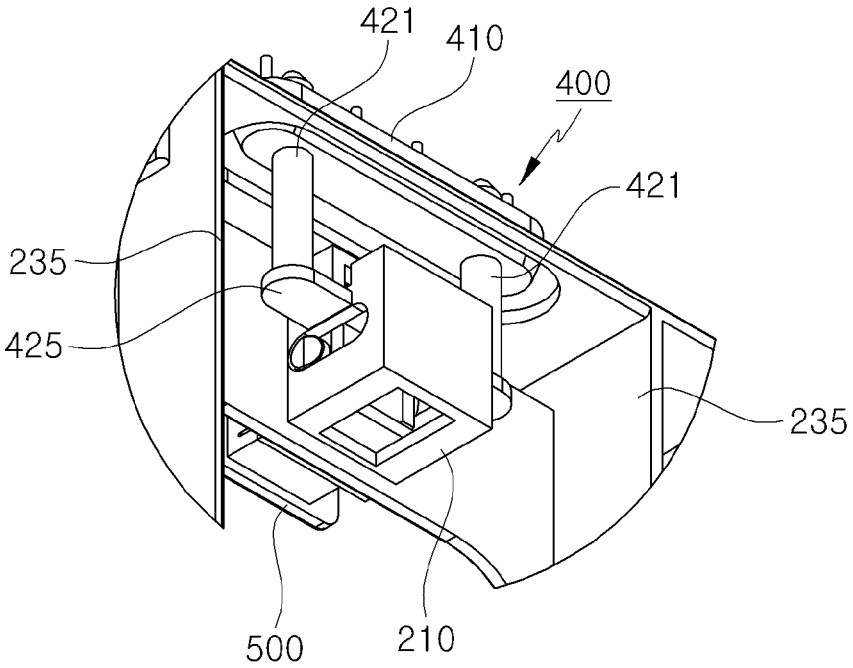
FIG. 9 is an enlarged view of a "B" part of FIG. 8.

As shown in FIGS. 4, 8 and 9, the exit member 200 may have a recess-shaped housing 210 formed above the second hole 201, and the push member 500 is inserted and mounted into the housing 210 to thereby lift the bar part 421 of the opening and closing member 400.

The housing 210 is opened at the top side such that the push member 500 and the bar part 421 of the opening and closing member 400 come into contact with each other. The housing 210 has guide grooves 211 elongated at right and left sides thereof, and as shown in FIG. 7, the push member 500 has guide protrusions 507 fit into the guide grooves 211 of the housing 210. The guide protrusions 507 fit into the guide grooves 211 help that the push member 500 moves forwardly and backwardly in the horizontal direction.

The left and right sides of the rectangular case part 503 of the push member 500 on which the guide protrusions 507 are formed may be elastically and detachably fit into the guide grooves 211 through cut lines 509. When the user presses the guide protrusions 507 to separate the guide protrusions 507 from the guide grooves 211, the push member 500 is easily separated from the housing 210. Therefore, the user can easily remove foreign matters stained on the push member 500 by washing the push member 500.

As shown in FIGS. 4 and 6, the housing 210 may have a second elastic member 213 mounted therein. The second elastic member 213 provides the push member 500 with elasticity so that the push member 500 can be actuated elastically. The second elastic member 213 is contracted when the push member 500 is pressed and is expanded when the push member 500 is released from pressure so as to be returned to its original position. It is preferable that the second elastic member 213 be made of a stainless steel material which is resistant to corrosion, and it is preferable that the second elastic member 213 be formed in a spring type.

The exit member 200 may have a first recess 215 formed in the face where the second hole 201 is formed. The second hole 201 and the housing 210 may be respectively formed in the second recess 215, and a first cover 610 for opening and closing the first recess 215 may be mounted in the first recess 215.

As shown in FIGS. 4 and 8, the exit member 200 may be a container of which the rear side facing the storage box 100 is opened. The exist member 200 has the first recess 215 formed in a front face 217 and has the second hole 201 and the housing 210 formed in the bottom of the first recess 215. In this instance, the exit member 200 has a through hole 221 formed in an upper face 219, such that the bar part 421 of the opening and closing member 400 mounted at the water outlet 301 of the water container 300 corresponds with the push member 500 by penetrating the through hole 221.

The first cover 610 protects the push member 500 and the dry tissue 1 and improves the outward appearance of the exit member 200. The first cover 610 is rotatably mounted in the first recess 215 to open and close the first recess 215.

As shown in FIG. 4, the first cover 610 has protrusions 611 which are respectively formed at the lower part thereof and spaced apart from each other at a predetermined interval and respectively have insertion holes 613, and the first recess 215 has brackets 223 which are respectively formed on the wall surface opposed to the lower part of the first cover 610 and respectively have fitting protrusions 225 inserted into the insertion holes 613. When the fitting protrusions 225 are respectively inserted into the insertion holes 613, the first cover 610 is rotated to open and close the first recess 215.

In this instance, the protrusions 611 may be elongated in a curved form, and the insertion holes 613 may be formed along the length of the protrusions 611. Additionally, the first recess 215 may have insertion holes 227 to which the protrusions 611 can be inserted. When the first cover 610 covers the first recess 215, the protrusions 611 are inserted into the insertion holes 227 so as to be hidden in the exit member 200. The part of the protrusions 611 entering the exit member 200 holds the water container 300 so that the water container 300 is not separated when the first cover 610 covers the first recess 215.

Figure 10:
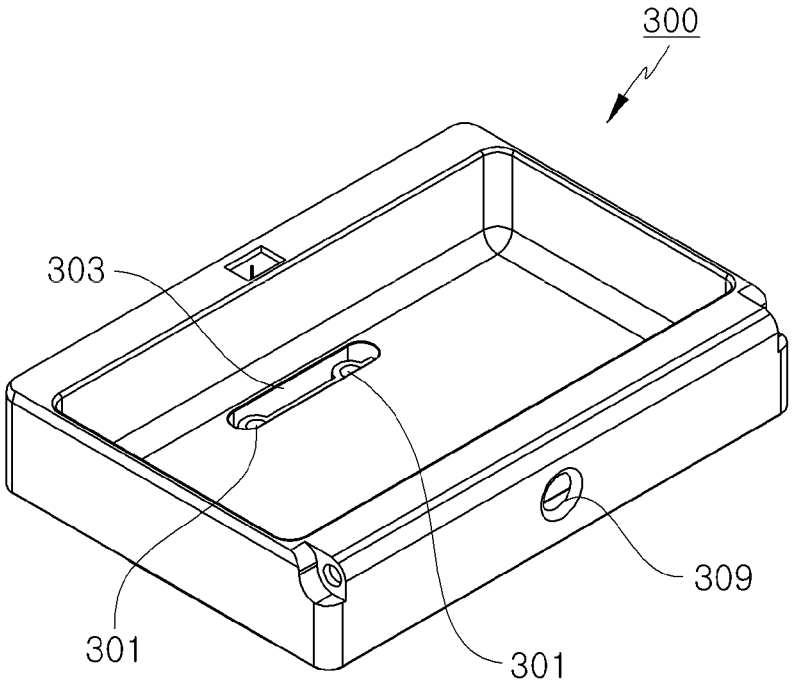
FIG. 10 is a view showing a water container from which the second cover is separated.

As shown in FIG. 10, the water container 300 may have a second recess 303. The water outlet 301 may be formed in the second recess 303, and the lid part 410 opens and closes the second recess 303 in a watertight manner so as to open and close the water outlet 301.

Figure 11:
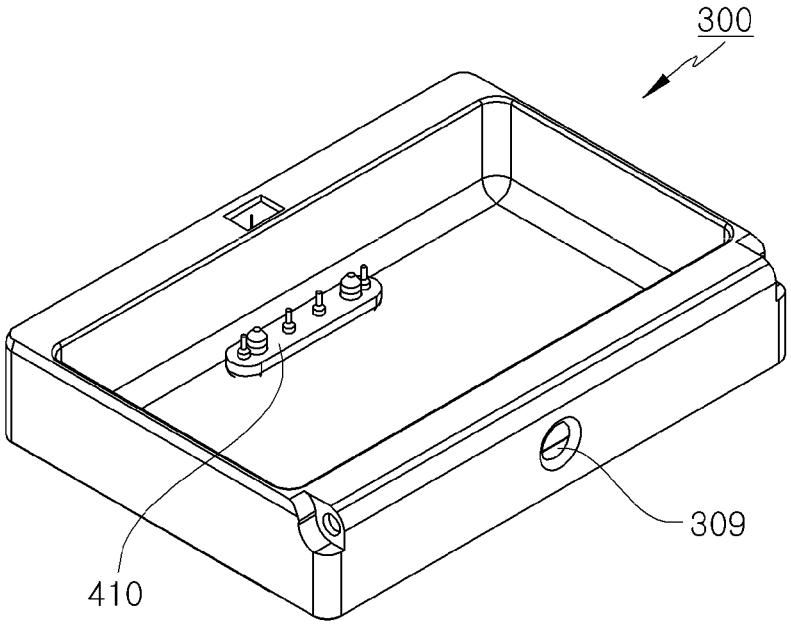
FIG. 11 is a view showing a state where the opening and closing member is mounted to the water container.

The water container 300 may be a container of which the upper face is opened. The water outlet 301 is formed at the bottom face of the water container 300, and the second recess 303 is formed in the bottom face of the water container 300 to surround the water outlet 301. As shown in FIG. 11, the lid part 410 is fit into the second recess 303 in a watertight manner to open and close the water outlet 301.

As shown in FIG. 10, a plurality of the water outlets 301 may be formed in the second recess 303, and as shown in FIG. 5, the bar part 421 of the opening and closing member 400 which are in the same number as the water outlets 301 may be fit into the water outlets 301 to thereby be connected with the lid part 410. In this instance, a plate body 425 for connecting the lower portions of the bar parts 421 is mounted at the lower portions of the bar parts 421 to fix the bar parts 421, and the first elastic members 423 are respectively mounted at the bar parts 421 to provide elasticity.

As shown in FIG. 6, a semicircular protrusion 427 corresponding to the protrusion 505 of the push member 500 is protrudingly formed beneath the plate body 425 in such a way as to lift the bar parts 421 when the push member 500 is actuated, so that the lid part 410 can open and close the second recess 303. In FIG. 5, the semicircular protrusion 427 is formed by the middle part of the plate body 425 bent in the form of a "ㄷ" shape, such that the structure of the wet tissue supply apparatus can be designed in a compact size.

When the second recess 303 is opened, because water contained in the water container 300 which is gathered inside the second recess 303 is drained into several streams of water through the water outlets 301, the dry tissue 1 coming out through the first hole 101 of the storage box 100 and the second hole 201 of the exit member 200 has got wet sufficiently so as to be made into wet tissue.

Figure 12:
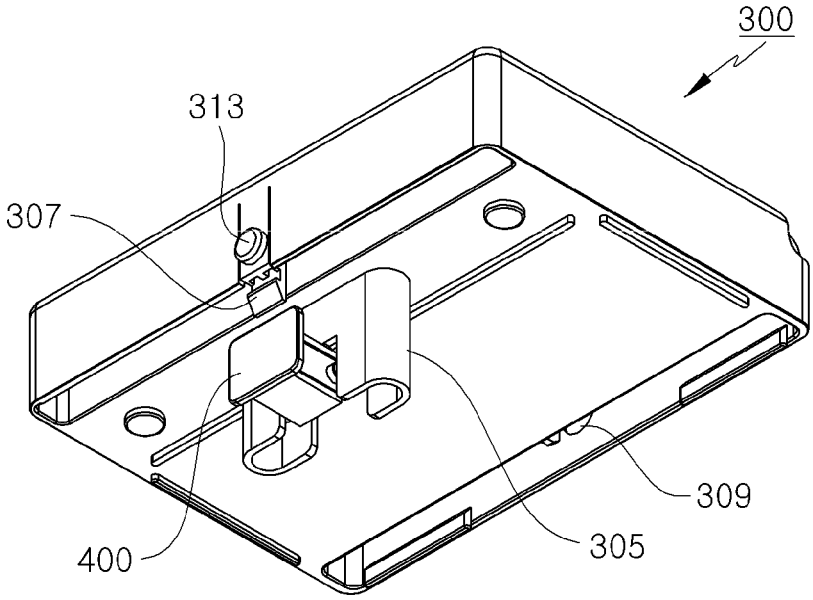
FIG. 12 is a bottom side view of the water container on which the push member is located at a skirt member.

As shown in FIG. 12, a skirt member 305 of an oval shape for guiding water of the water outlet 301 to the dry tissue is mounted beneath the water container 300, and the bar parts 421 are located inside the skirt member 305. In this instance, the push member 500 protrudes through the skirt member 305 to lift the bar parts 421. The skirt member 305 has insertion spaces (which have no reference numerals) formed at the front side and the rear side thereof and the housing 210 is located in the insertion spaces, such that the push member 500 penetrates through the skirt member 305.

In a case that water drained through the water outlet 301 is splashed in all directions by being bumped against the plate body 425, the housing 210 or the push member 500, the skirt member 305 stops the splash of water and makes water flow into the dry tissue 1 and makes water and makes the water be gathered in the gutter member 800 in safety. The skirt member 305 has a size to surround the entire second recess 303 or the water outlet 301.

Not shown in the drawings, but a water sprinkling member for sprinkling water into several streams like a shower may be mounted inside the skirt member 305. The water sprinkling member is fixed on the surface of the inner wall of the skirt member 305. The water sprinkling member is in a rectangular shape and has a plurality of sprinkling holes arranged along a plurality of groove lines. The water of the water outlet 301 flows along the groove lines and the sprinkling holes sprinkle water into several streams so as to make the dry tissue 1 wet. The water sprinkling member can evenly spray water of the water outlet 301 to the dry tissue 1.

Figure 2:
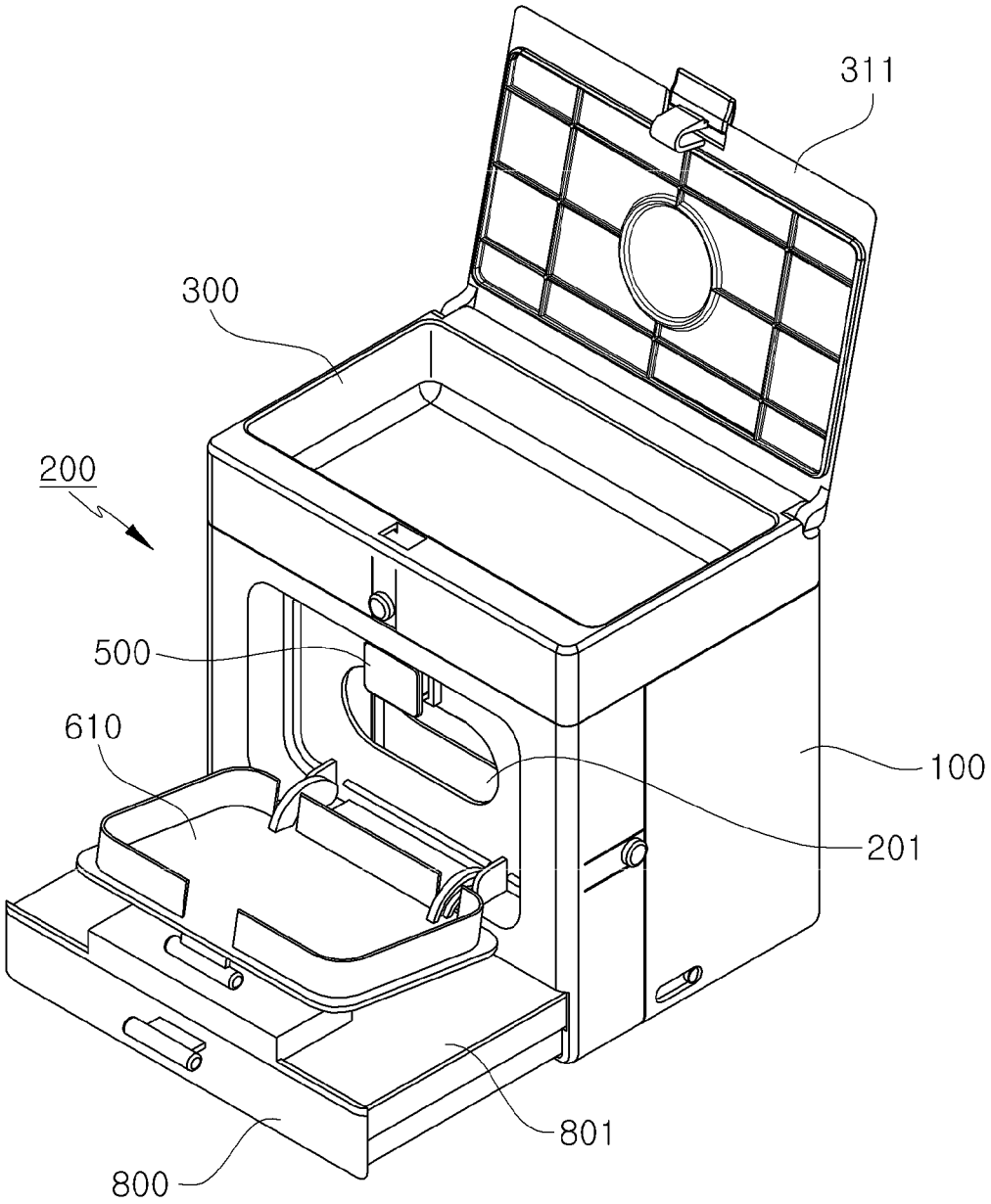
FIG. 2 is a view showing a state where a first cover, a second cover and a gutter member of the wet tissue supply apparatus are opened.
Figure 3:
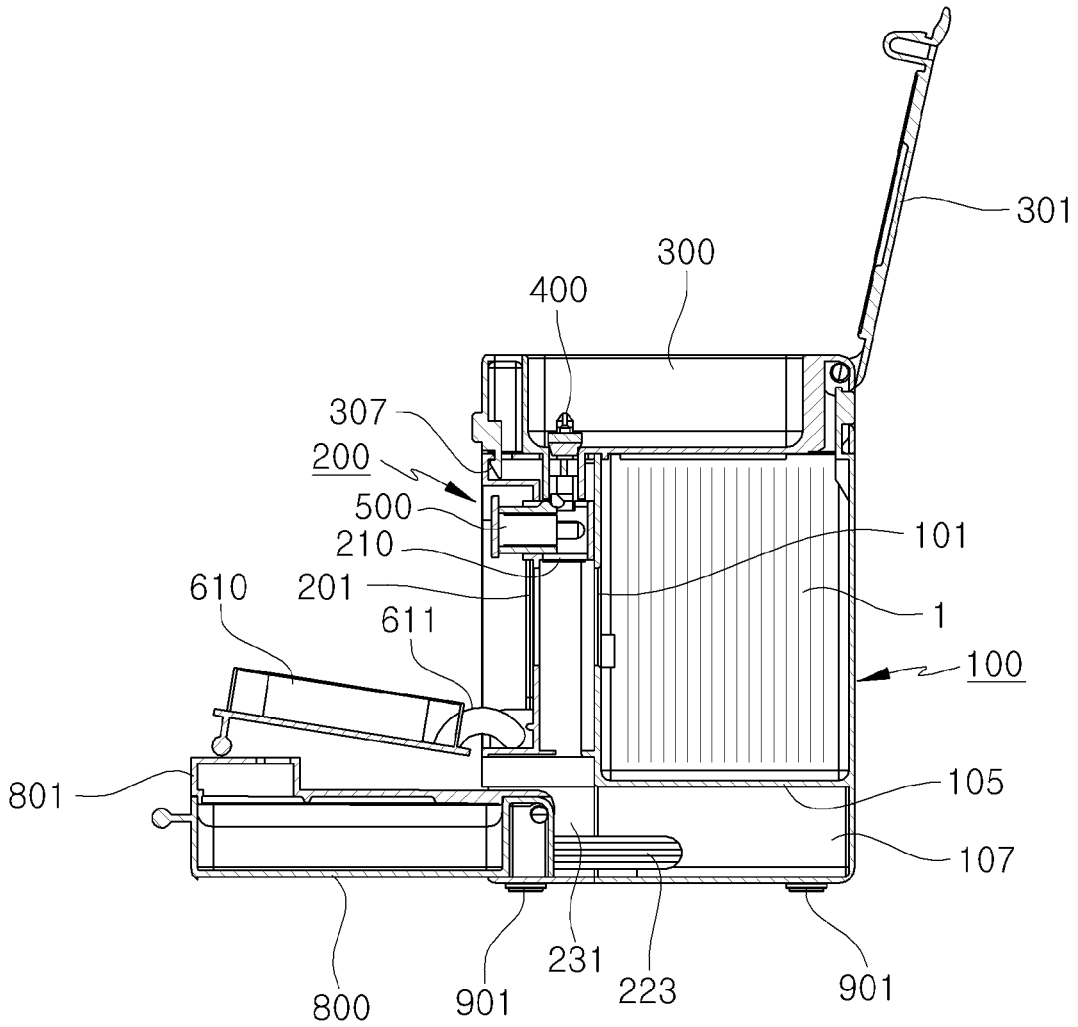
FIG. 3 is a sectional view taken along the line of A-A of FIG. 1.

As shown in FIGS. 2 to 4, the water container 300 may be a container of which the upper face is opened. A second cover 311 for opening and closing the opened upper face is rotatably mounted on the water container 300. The water container 300 has an insertion hole (which has no reference numeral) formed at one side of the opened upper face, and the second cover 311 has a protrusion (which has no reference numeral) fit into the insertion hole, such that the second cover 311 can open and close the water container 300 while rotating at the opened upper face.

The second cover 311 is made of a transparent material to easily measure water levels of the water container 300. A first packing member (not shown) is mounted at the edge of the opened upper face of the water container 300 to provide watertightness between the water container 300 and the second cover 311.

As shown in FIGS. 1 to 4, the water container 300 may be detachably mounted to the exit member 200 and the storage box 100. The storage box 100 is a container of which the upper face is opened, and when the water container 300 is separated from the exit member 200 and the storage box 100, the upper face of the storage box 100 is opened. The user can fill the storage box 100 with dry tissues 1 through the opened upper face when the water container 300 is separated from the storage box 100.

As shown in FIGS. 11 and 12, the water container 300 has a first retaining protrusion 307 formed at the front side and a first retaining hole 309 formed at the rear side so as to be detachably connected to the exit member 200 and the storage box 100. The user can easily wash and dry the water container 300 by separating the water container 300 from the storage box 100 so as to always keep a clean condition.

Figure 13:
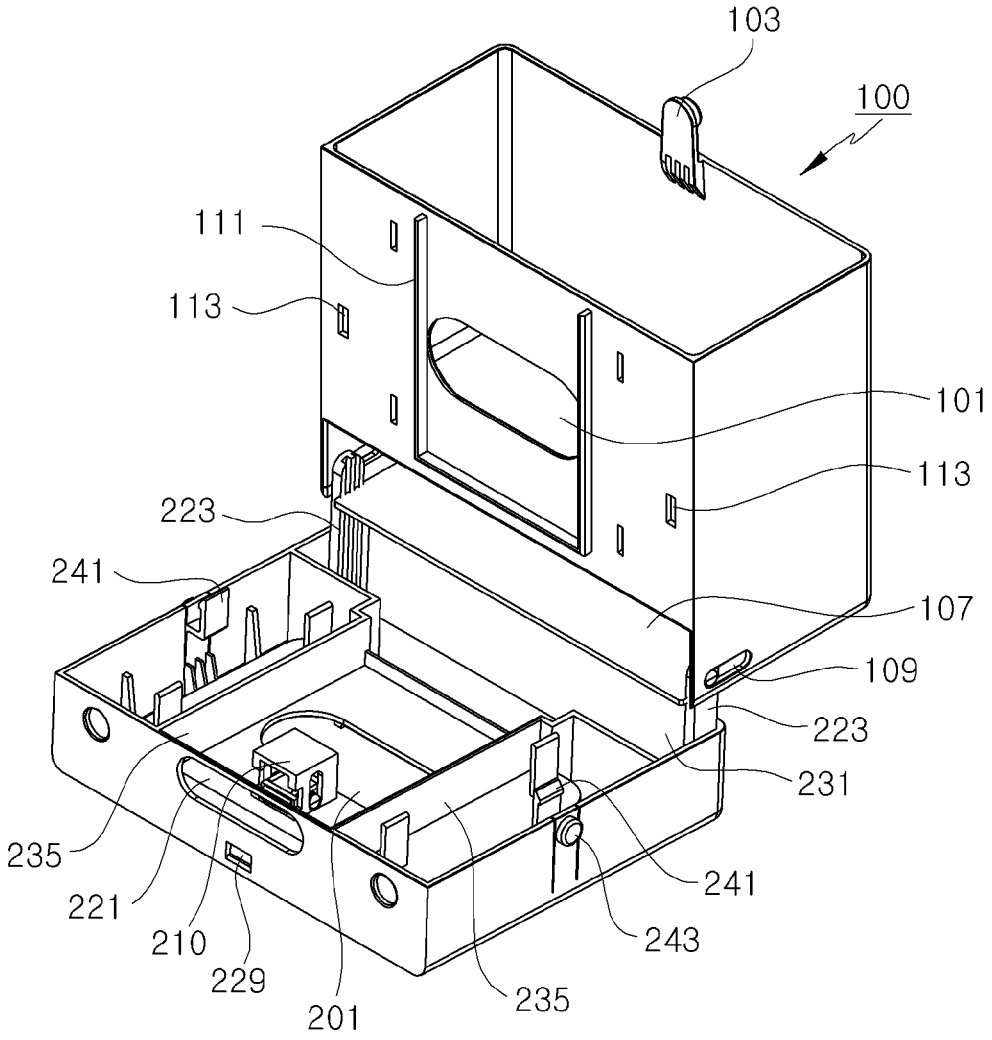
FIG. 13 is a view showing a state where the exit member is opened from a storage box.

The exit member 200 has a second retaining hole 229 retained to the first retaining protrusion 307 so as to be detachably connected with the water container 300 (See FIG. 13). The first retaining protrusion 307 has a hook-shaped retaining jaw formed at an end thereof to be caught to the second retaining hole 229. The first retaining protrusion 307 may protrude toward the bottom of the water container 300 from the front side of the water container 300. The water container 300 has a push button 313 which is formed at the front side and elastically actuates through the cut line. When the user presses the first push button 313, the first retaining protrusion 307 is pushed, such that the retaining jaw of the first retaining protrusion 307 which is caught to the second retaining hole 229 can be removed.

The storage box 100 has a second retaining protrusion 103 which is caught to the first retaining hole 309 so as to be detachably connected with the water container 300 (See FIG. 13). The second retaining protrusion 103 has a round protrusion (which has no reference numeral) which is inserted into the first retaining hole 309 so as to be detachably connected with the water container 300. When the round protrusion fit into the first retaining hole 309 is pushed out, the water container 300 is easily separated from the storage box 100.

As shown in FIGS. 1 to 4, the gutter member 800 which traverses the exit member 200 and the storage box 100 is mounted beneath the exit member 200 and beneath the storage box 100. The gutter member 800 goes in and out in a drawer type. The gutter member 800 collects the remaining water of the water outlet 301 which does not soak into the dry tissue 1.

The gutter member 800 may be a container of which the upper face is opened, and a third cover 801 which opens and closes the opened upper face may be rotatably mounted. The gutter member 800 has an insertion hole (which has no reference numeral) formed at one side of the opened upper face, and the third cover 801 has a protrusion (which has no reference numeral) formed and fit into the insertion hole, such that the third cover 801 can open and close the gutter member 800 while rotating at the opened upper face.

The third cover 801 prevents the gathered water in the gutter member 800 from being drained to the outside. The third cover 801 has a recovery hole 803 to recover the water of the water outlet 301 to the gutter member 800 through the recovery hole 803. When the first cover 610 covers the first recess 215, the protrusion 611 which enters the exit member 200 is fit into the recovery hole 803 of the third cover 801, such that the water container 300 is not separated. A second packing member (not shown) may be mounted at the edge of the opened upper face of the gutter member 800 to provide watertightness between the gutter member 800 and the third cover 801.

As shown in FIG. 3, the exit member 200 has a hole 231 formed at the lower portion thereof and the storage box 100 has a space 107 formed at the lower portion thereof by a partition wall 105, and the gutter member 800 is inserted into the hole 231 and the space 107 to be drawn in and out in a drawer type while traversing the exit member 200 and the storage box 100.

As shown in FIG. 13, the exist member 200 may be detachably mounted on the storage box 100 to be rotated. The exit member 200 may be fixed to the storage box 100 to be mounted integrally, but it is preferable that the exit member 200 be mounted detachably so as to be easily washed. The exit member 200 is rotated and separated from the storage box 100 when the water container 300 is separated from the exit member 200 and the storage box 100.

The exit member 200 has third retaining protrusions 223 respectively formed at right and left sides of the inner face, and the storage box 100 has third retaining holes formed corresponding to the third retaining protrusions 223. The third retaining protrusions 223 respectively have round protrusions (which have no reference numerals) formed at ends thereof. When the round protrusions are inserted and fit into the third retaining holes 109, the exit member 200 is rotated and detachably mounted to the storage box 100. The third retaining holes 109 are elongated holes. When the round protrusions are pushed after the exit member 200 is pulled forwardly from the storage box 100 to be opened, the exit member 200 is drawn out from the third retaining hole 109.

Moreover, the exit member 200 has fourth retaining protrusions 241 so as to be firmly and detachably connected to the storage box 100. The fourth retaining protrusions 241 respectively protrude from the left and right sides of the exit member 200. The storage box 100 has fourth retaining holes 113 which are formed in the front face thereof and correspond with the fourth retaining protrusions 241. The fourth retaining protrusions 241 respectively have hook-shaped retaining jaws formed at ends thereof so as to be caught to the fourth retaining holes 113. The exit member 200 has second push buttons 243 which are formed at left and right sides thereof to be elastically actuated through the cut lines. When the user presses the second push buttons 243 to push the fourth retaining protrusions 241, the retaining jaws of the fourth retaining protrusions 241 caught to the fourth retaining holes 113 can be drawn out.

As shown in FIG. 13, projecting parts 111 and 235 which get in contact with each other to form a movement path of the dry tissues 1 may be respectively formed on the opposed faces of the storage box 100 and the exit member 200. The projecting part 111 is formed at the front face of the storage box 100 while surrounding the first hole 101. In the drawing, the projecting part 111 is formed in a "ㄷ" shape. The projecting part 235 protrudes from the front face of the exit member 200. The projecting parts 111 and 235 come into contact with each other when the storage box 100 and the exit member 200 are connected with each other so as to form the movement path of the dry tissue 1.

As shown in FIG. 4, slide preventing members 901 are mounted at the lower portions of the exit member 200 and the storage box 100 in order to prevent slide of the exit member 200 and the storage box 100.

Figure 15:
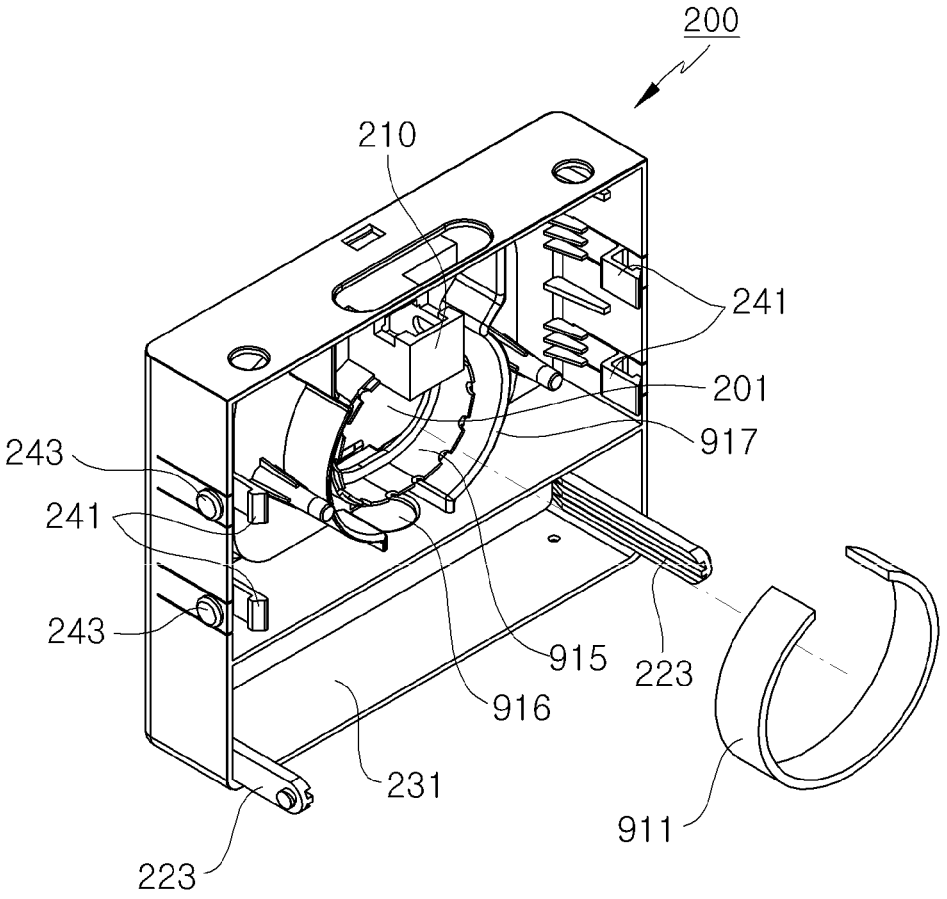
FIG. 15 is a view showing an exit member of the wet tissue supply apparatus according to the second preferred embodiment of the present invention.

As shown in FIG. 15, the exit member 200 has a first water-absorbing member 911. The first water-absorbing member 911 may be made of a sponge material which absorbs water well. The first water-absorbing member 911 is mounted at the rear of the front face of the exit member 200 to surround the second hole 201 and absorbs water of the water outlet 301 to make the dry tissue 1 wet. The exit member 200 surrounds the second hole 201 in such a way that a first installation protrusion 915 protrudes, and the first water-absorbing member 911 is detachably fit and mounted to the first installation protrusion 915.

Figure 17:
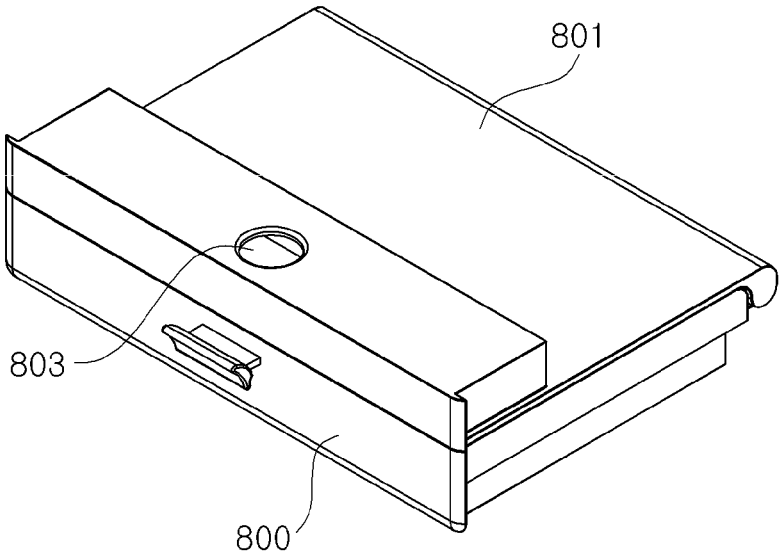
FIG. 17 is a view showing a gutter member of the wet tissue supply apparatus according to the second preferred embodiment of the present invention.

The water of the water outlet 301 is drained to the first water-absorbing member 911, and the dry tissue 1 gets wet by absorbing water from the first water-absorbing member 911. The first water-absorbing member 911 evenly supplies water to the dry tissue 1 passing through the first water-absorbing member 911, such that the dry tissue 1 evenly gets wet. Water exceeding the water content of the first water-absorbing member 911 flows down and is collected into the water container 300. The reference numeral 916 designates an induction hole for inducing the water exceeding the water content of the first water-absorbing member 911 toward the recovery hole 803 of the water container 300 shown in FIG. 17. The reference numeral 917 designates a jig for supporting the first water-absorbing member 911 fit to the first installation protrusion 915.

Figure 16:
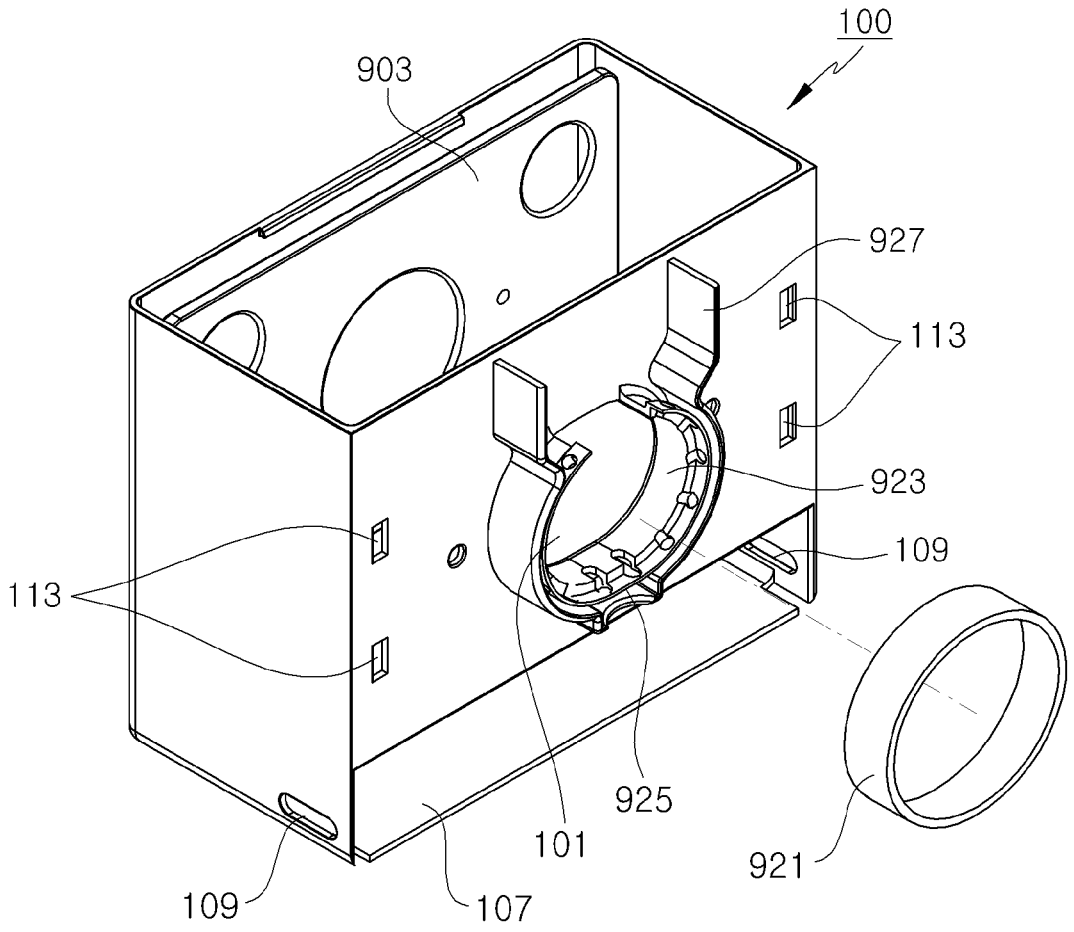
FIG. 16 is a view showing a storage box of the wet tissue supply apparatus according to the second preferred embodiment of the present invention.

As shown in FIG. 16, a second water-absorbing member 921 is mounted in the storage box 100. The second water-absorbing member 921 may be made of the same material as the first water-absorbing member 911. The second water-absorbing member 921 surrounds the first hole 101 and mounted in front of the front face of the storage box 100 in such a way as to come into contact with the first water-absorbing member 911 so as to form a movement path of the dry tissue 1 together with the first water-absorbing member 911. The storage box 100 surrounds the first hole 101 and makes a second installation protrusion 923 protrude, such that the second water-absorbing member 921 is detachably fit and mounted to the second installation protrusion 923.

The second water-absorbing member 921 can get wet by directly receiving water from the water outlet 301 or can get wet by indirectly receiving water of the water outlet 301 from the first water-absorbing member 911. The second water-absorbing member 921 evenly supplies water to the dry tissue 1 passing together with the first water-absorbing member 911 so as to evenly make the dry tissue 1 wet. The water exceeding the water content of the second water-absorbing member 921 flows down and is collected into the water container 300. The reference numeral 925 designates an induction protrusion for inducing the water exceeding the water content of the second water-absorbing member 921 toward the recovery hole 803 of the water container 300 shown in FIG. 17. The reference numeral 927 designates a jig for supporting the second water-absorbing member 921 fit to the second installation protrusion 923.

As shown in FIG. 16, a push plate member 903 for elastically pushing the dry tissue 1 may be mounted inside the storage box 100. The push plate member 903 has an elastic spring member (not shown) between the push plate member 903 and the storage box 100 in order to elastically push the dry tissue 1. The push plate member 903 pushes the dry tissue 1 toward the first hole 101 such that the user can draw out the dry tissue 1 even though the dry tissue 1 of a small quantity remains and the dry tissue 1 is supported not to fall down.

Figure 14:
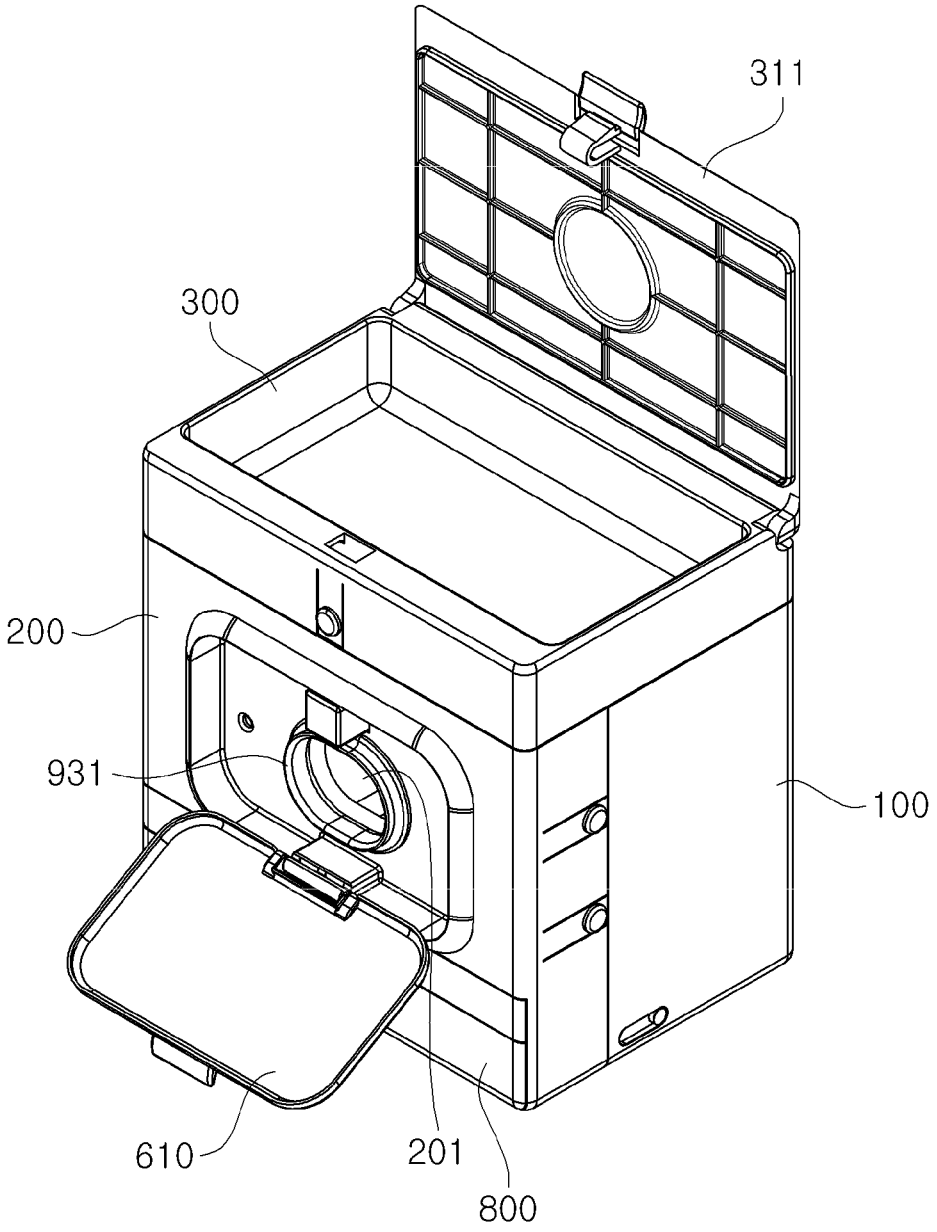
FIG. 14 is a view showing a wet tissue supply apparatus according to another preferred embodiment of the present invention.

As shown in FIG. 14, the second hole 201 may have a leak preventing member 931. The leak preventing member 931 is formed in a ring shape and inserted and fixed into the second hole 201 in order to prevent water excessively absorbed to the dry tissue 1 from leaking to the outside when the user draws out the dry tissue 1 wetting with the water from the second hole 201. The leak preventing member 931 has elasticity, and is preferably made of a silicon material. The leak preventing member 931 squeezes the tissue 1 soaked with water by providing elasticity when the user draws out the tissue 1 so as to prevent the exceeding water from leaking to the outside.

The wet tissue supply apparatus according to the preferred embodiments of the present invention can easily convert dry tissue into wet tissue just using water, such as mineral water, purified water, tap water or the like, at home, in restaurants, industrial sites, and so on, thereby having no harmfulness of preservatives or other chemical ingredients because.

Moreover, the wet tissue supply apparatus according to the preferred embodiments of the present invention is not harmful to human bodies and allows the user to make sanitary and clean wet tissue anytime and anywhere because it has a compact structure and is easy to carry.

Furthermore, the wet tissue supply apparatus according to the preferred embodiments of the present invention allows the user to selectively use wet tissue and dry tissue using one apparatus because the user can draw out dry tissue without making wet tissue. Therefore, there is no need for the user to prepare dry tissue separately.

While the present invention has been particularly shown and described with reference to preferred embodiments thereof, it will be understood by those of ordinary skill in the art that various changes and modifications may be made therein without departing from the essential technical scope of the present invention. Here, the essential technical scope of the present invention is shown in the claims of the present invention, and it would be interpreted that all differences belonging to the equivalent technical scope belong to the claims of the present invention.

Explanation of reference numerals in drawings

| | |
|---|---|
| 100: storage box | 101: first hole |
| 103: second retaining protrusion | |
| 105: partition wall | 107: space |
| 109: third retaining hole | |

-continued

| Explanation of reference numerals in drawings | |
|---|---|
| 111: projecting part | 113: fourth retaining hole |
| 200: exit member | 201: second hole |
| 210: housing | 211: guide groove |
| 213: second elastic member | |
| 215: first recess | 217: front face |
| 219: upper face | 221: through hole |
| 223: bracket | 225: fitting protrusion |
| 227: insertion hole | 229: second retaining hole |
| 231: hole | 233: third retaining protrusion |
| 235: projecting part | 241: fourth retaining protrusion |
| 243: second push button | |
| 300: water container | 301: water outlet |
| 303: second recess | 305: skirt member |
| 307: first retaining protrusion | |
| 309: first retaining hole | |
| 311: second cover | 313: first push button |
| 400: opening and closing member | |
| 410: lid part | 421: bar part |
| 423: first elastic member | |
| 425: plate body | 427: semicircular protrusion |
| 500: push member | 501: horizontal plate part |
| 503: rectangular case part | |
| 505: protrusion | 507: guide protrusion |
| 509: cut line | 610: first cover |
| 611: protrusion | 613: insertion hole |
| 800: gutter member | 801: third cover |
| 803: recovery hole | 901: slide preventing member |
| 903: push plate member | 905: elastic spring member |
| 911: first water-absorbing member | |
| 921: second water-absorbing member | |
| 931: leak preventing member | |

What is claimed is:

1. A wet tissue supply apparatus comprising:

a storage box containing dry tissues put on top of each other therein and having a first hole;

an exit member having a second hole which is opposed to the first hole inside the storage box, the exit member enabling a user to draw out the dry tissues contained in the storage box through the first hole;

a water container which is mounted above the exit member and the storage box and has a water outlet;

an opening and closing member mounted at the water outlet of the water container and located between the first hole and the second hole to open and close the water outlet while being lifted; and a push member mounted on the exit member and located beneath the opening and closing member to lift the opening and closing member, wherein the dry tissue gets wet with the water of the water container while passing between the first hole and the second hole.

2. The wet tissue supply apparatus according to claim 1, wherein the opening and closing member comprises a lid part for opening and closing the water outlet and bar parts connected to the lower portion of the lid part, and the push member lifts the bar parts upwardly such that the lid part opens and closes the water outlet.

3. The wet tissue supply apparatus according to claim 2, wherein the bar parts are elastically lifted by a first elastic member mounted between the lower portions of the bar parts and the water container.

4. The wet tissue supply apparatus according to claim 2, wherein the push member comprises a protrusion for lifting the bar parts upwardly.

5. The wet tissue supply apparatus according to claim 4, wherein the protrusion has an inclined face to lift the bar parts upwardly, and wherein the bar part is located above the inclined face such that the lid part opens the water outlet when the push member moves forwardly toward the storage box, and the bar part is located beneath the inclined face such that the lid part closes the water outlet when the push member moves backwardly.

6. The wet tissue supply apparatus according to claim 4, wherein the protrusion is formed in a semicircular shape to lift the bar parts upwardly, and wherein the lid part opens the water outlet twice when the bar part is located above the protrusion while the push member moves forwardly and backwardly toward the storage box, but closes the water outlet when the bar part goes over the protrusion.

7. The wet tissue supply apparatus according to claim 6, wherein in a case that there are a plurality of the water outlets, a plate body for connecting lower portions of the bar parts is further mounted, and a semicircular protrusion corresponding to the protrusion is further formed beneath the plate body.

8. The wet tissue supply apparatus according to claim 2, wherein a recess type housing is formed above the second hole of the exit member, and the push member is inserted and mounted into the housing to lift the bar parts upwardly.

9. The wet tissue supply apparatus according to claim 8, wherein the housing has an upper face which is opened such that the push member and the bar parts come into contact with each other, and the housing includes guide grooves formed at left and right sides thereof, and the push member includes guide protrusions inserted into the guide grooves.

10. The wet tissue supply apparatus according to claim 9, wherein the face of the push member on which the guide protrusion is formed is elastically and detachably fit into the guide groove through a cut line.

11. The wet tissue supply apparatus according to claim 8, wherein the housing includes a second elastic member mounted inside the housing to elastically actuate the push member.

12. The wet tissue supply apparatus according to claim 8, wherein the exit member comprises a first recess formed in the face where the second hole is formed, and the second hole and the housing are respectively formed in the first recess, and a first cover is mounted at the first recess to open and close the first recess.

13. The wet tissue supply apparatus according to claim 12, wherein the first cover is rotatably mounted at the first recess to open and close the first recess.

14. The wet tissue supply apparatus according to claim 2, wherein the water container has a second recess, the water outlet is formed in the second recess, and the lid part opens and closes the second recess in a watertight manner to open and close the water outlet.

15. The wet tissue supply apparatus according to claim 2, wherein a skirt member of an oval shape for guiding the water of the water outlet to the dry tissue is mounted beneath the water container, and the bar parts are located inside the skirt member, and the push member penetrates the skirt member to lift the bar parts upwardly.

16. The wet tissue supply apparatus according to claim 15, wherein the skirt member includes a water sprinkling member mounted therein to sprinkle the water of the water outlet into several streams.

17. The wet tissue supply apparatus according to claim 16, wherein the water sprinkling member includes a plurality of sprinkling holes and groove lines for inducing the water of the water outlet to the sprinkling holes.

18. The wet tissue supply apparatus according to claim 1, wherein the water container is detachably connected to the exit member and the storage box.

19. The wet tissue supply apparatus according to claim 18, wherein the storage box is a container of which upper face is opened, and the upper face is opened when the water container is separated from the exit member and the storage box.

20. The wet tissue supply apparatus according to claim 1, wherein the water container is a container of which upper face is opened, and a second cover is rotatably mounted at the water container to open and close the opened upper face.

21. The wet tissue supply apparatus according to claim 20, wherein a first packing member is mounted in the water container to provide watertightness between the water container and the second cover.

22. The wet tissue supply apparatus according to claim 1, further comprising:

a gutter member which traverses a lower portion of the exit member and a lower portion of the storage box and goes in and out in a drawer type.

23. The wet tissue supply apparatus according to claim 22, wherein the gutter member is a container of which upper face is opened.

24. The wet tissue supply apparatus according to claim 23, wherein the gutter member includes a third cover rotatably mounted to open and close the opened upper face of the gutter member, and the third cover has a recovery hole for recovering the water of the water outlet to the gutter member.

25. The wet tissue supply apparatus according to claim 24, wherein the gutter member includes a second packing member to provide watertightness between the gutter member and the third cover.

26. The wet tissue supply apparatus according to claim 1, wherein the exit member is detachably mounted at the storage box to be able to rotate.

27. The wet tissue supply apparatus according to claim 1, wherein projecting parts which get in contact with each other are respectively formed on the opposed faces of the storage box and the exit member to form a movement path of the dry tissues.

28. The wet tissue supply apparatus according to claim 1, wherein a slide preventing member is mounted at the lower portions of the exit member and the storage box.

29. The wet tissue supply apparatus according to claim 1, wherein the storage box includes a push plate member mounted therein to elastically push the dry tissue.

30. The wet tissue supply apparatus according to claim 1, wherein the exit member includes a first water-absorbing member mounted to surround the second hole in order to wet the dry tissue by absorbing the water of the water outlet.

31. The wet tissue supply apparatus according to claim 30, wherein the storage box includes a second water-absorbing member mounted to surround the first hole in order to wet the dry tissue by absorbing the water of the water outlet.

32. The wet tissue supply apparatus according to claim 31, wherein the first and second water-absorbing members are mounted detachably.

33. The wet tissue supply apparatus according to claim 1, wherein the second hole includes a leak preventing member to prevent water from leaking to the outside when the user draws out the dry tissue soaked with the water of the water outlet from the second hole.

* * * * *